United States Patent [19]

Eirich et al.

[11] 4,050,637

[45] Sept. 27, 1977

[54] PULVERIZING APPARATUS WITH A TOOTHED DISC

[76] Inventors: Wilhelm Eirich, Bahnhofstr. 19; Gustav Eirich, Walldurnerstr. 41, both of Hardheim, Germany

[21] Appl. No.: 650,904

[22] Filed: Jan. 21, 1976

[30] Foreign Application Priority Data

Jan. 29, 1975 Germany ..... 2503621

[51] Int. Cl.[2] ..... B02C 23/24

[52] U.S. Cl. ..... 241/56; 241/46.17; 241/199.7

[58] Field of Search ..... 241/55, 56, 187, 199.7, 241/199.12; 259/84, 93

[56] References Cited

U.S. PATENT DOCUMENTS

| | | | |
|---|---|---|---|
| 158,805 | 1/1875 | Morrell | 241/199.7 |
| 2,464,588 | 3/1949 | Knudsen et al. | 241/46.17 |
| 2,592,334 | 4/1952 | Reiffen | 259/84 |
| 2,808,239 | 10/1957 | Reiffen | 259/84 |
| 3,170,638 | 2/1965 | Burton | 241/46.17 |
| 3,674,241 | 7/1972 | Eirich et al. | 259/84 |
| 3,809,322 | 5/1974 | Hirosawa | 241/199.7 |

*Primary Examiner*—Granville Y. Custer, Jr.
*Attorney, Agent, or Firm*—Miller & Prestia

[57] ABSTRACT

The invention relates to a pulverizing apparatus, particularly for elastic, viscous and bulky materials, as well as refuse and other waste materials, with a driven container and at least one eccentrically disposed high-speed tool which has a shaft disposed approximately parallel with the axis of the container.

16 Claims, 10 Drawing Figures

PULVERIZING APPARATUS WITH A TOOTHED DISC

BACKGROUND OF THE INVENTION

It is known that environmental experts are increasingly aware of the growing quantities of refuse at both municipal and parish level, as well as from industry. Large and modern refuse elimination plants, by virtue of circumstances, can only convert waste into another form even though the latter may occupy less volume than the starting material.

Also the situation in the case of stocks of raw materials in world economy have resulted in the knowledge that it is essential to strive for better utilization of available raw materials, manufacturing residues and waste. Desirable, therefore, would be an apparatus for comminuting heterogeneous materials, e.g. household and industrial refuse, occurring in large quantities, even when supplied in sacks, and of the high grade materials contained in this refuse, such as paper or packaging materials of all kinds, textiles materials, etc. After their comminution, such materials could be fed to other further processing stages, but a necessary condition is a suitable pulverising apparatus.

A further problem exists in the paper and woodfiber board producing industry: timber production is incapable of coping with the rapidly increasing consumption of paper. Therefore, it seems important to be able to process tree residues such as branch and root timber and also bark, hitherto unused, in the aforesaid industry for the production of papers, fibreboard and insulating board.

Known methods are scarcely capable of processing elastic, viscous, moist, sticky or bulky materials. At least, no efficient and competitively priced machine is available for a rational pulverising of such materials.

The incineration plants often used have the great disadvantage of leaving about 35 to 50% by weight of residue, even though the volume shrinks to about 1/10th that of the starting material.

The depositing of these residues without adversely affecting the nature of the ground-water is a difficult problem. Also contamination of the air by combustion gases creates difficulties. Only very expensive purification plants can either purify the waste gases and carry away the poison in liquid form, jeopardizing the ground-water, and also this is frequently undesirable.

Furthermore, it must be remembered that, for example, refuse contains large quantities of metal and in any rational pulverizing of such mass materials, it is particularly essential to use a high rate of throughput of the pulverizing machines, with economical power consumption and a low rate of wear. Separation of the metal parts, at least of the ferrous metals, presents difficulty particularly when these parts are supplied to the pulverizing machine in filled refuse sacks, cartons or bundles. The over-belt magnets and other magnetic separating devices which have been used in the past are scarcely capable of separating iron parts which are present in refuse bags, sacks, cartons and the like.

SUMMARY OF THE INVENTION

Therefore, the invention is based on the problem of providing a pulverizing apparatus of the type mentioned at the outset, which can very effectively and with minimum mechanical-technical complication provide for both manufacturing residues and also refuse or raw materials of practically any range of consistency, to be pre-comminuted of finely comminuted and blended also providing, if necessary a magnetic separation phase.

According to the invention, this problem is resolved in that the high speed tool is provided with at least one toothed disc, the plane of which extends transversely with respect to the tool shaft, and which to a certain extent dips into the material present at the wall of the container, that is the high speed tool is more or less radially displaceable in the container. In this respect, the invention utilizes the action of centrifugal force in a rapidly rotating container which is driven at above-critical speed. It goes without saying that circular saws are already known per se for wood and even for metal. The problem arising with the comminution of bulky, elastic and viscous materials to the point of the same being pulverizing, residues, according to the present invention, in bringing the aforesaid materials into the range of action of the toothed circular disc.

DETAILED DESCRIPTION AND PREFERRED EMBODIMENTS

Further advantages, features and possibilities of application of the present invention will become manifest from the ensuing description in conjunction with the drawings, in which:

FIG. 1 diagrammatically shows in plan view a pulverizing apparatus according to the invention, having two eccentrically disposed high speed tools, a discharge orifice and the apparatus for adjusting one tool in the container;

The principle underlying the invention is based on the knowledge that the materials in question could be comminuted with a toothed circular disc. In another connection and with other kinds of machine, the use of a container driven at an above-critical speed is already known. The term critical speed is understood, with regard to the container drive, to be that number of revolutions per minute at which the centrifugal force is greater than the weight of the relevant material, so that the material is maintained against the inside walls of the container during rotation.

Figure 1:
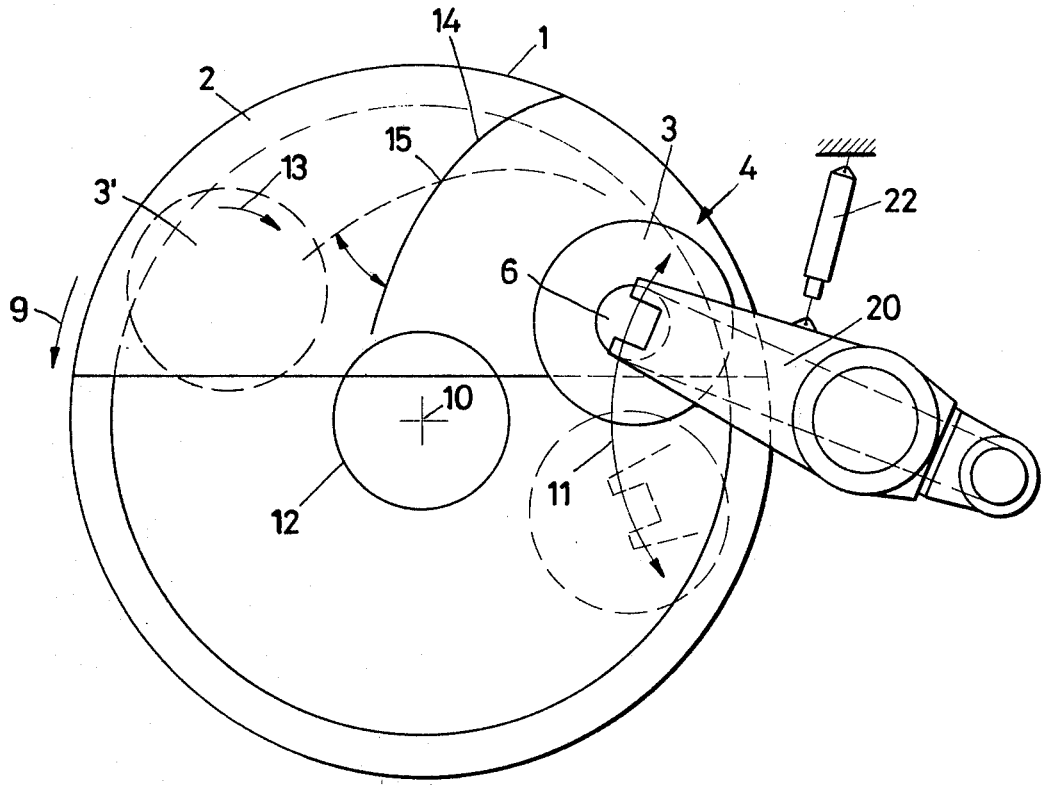
Figure 4:
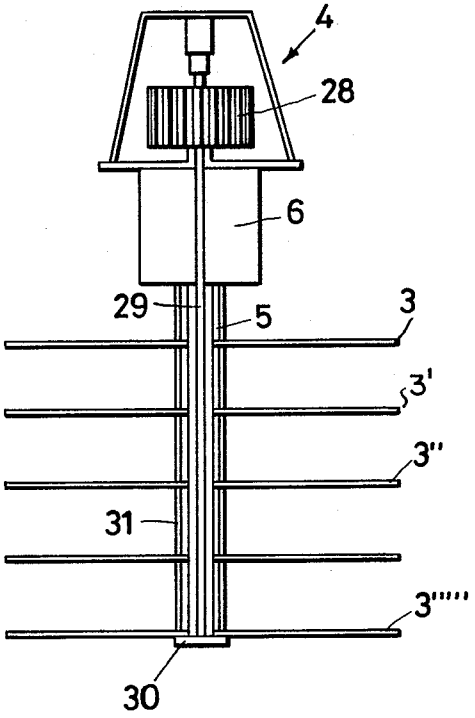
FIG. 4 is a side view of the high speed tool with the chucking device disposed at the top.

The container 1 of the pulverizing apparatus according to the embodiment shown in FIGS. 1 to 4 can during pulverizing be driven at above-critical speed of various stages and at different speeds: possibly for pre-comminution at a lower even though above-critical speed, and in the case of a fine pulverizing stage, at a speed which is increased to considerably higher levels for an increase in mass up to 2 to 100 times (in the case of fine granulation possibly 300 times). The container wall is smooth or slightly ribbed on the inside. As indicated in FIG. 1, the already pre-comminuted material which has to be further reduced in size is shown at 2 as resting thereon. The circular toothed disc 3 of the right-hand high speed tool or 3' of the tool shown on the left in broken lines in FIG. 1 has its periphery partly immersed in the material 2. The high speed tool generally designated 4 has, as shown in FIG. 4, five superposed circular toothed discs 3, 3', etc. For rapid exchange purposed, these toothed discs are separably mounted on the shaft 5 on the tool 4, the shaft having at its upper end a V-belt pulley 6 and being driven by the motor 8 via the V-belt 7 shown diagrammatically in FIG. 2.

FIG. 1 shows a pivotally attached deflector which is only required when the machine is operating periodically, being then used for discharging the material through the discharge orifice 12 in the middle of the container. When bulky material is being processed, during the actual pulverizing process the deflector 14 is raised so that it does not constitute an obstruction. In the case of non-bulky material, the deflector can either by pivoted or lifted out about an axis 15 so that it does not engage into the layer of material during the pulverizing process and will not cause any friction losses. When handling bulky refuse, the largest possible free inlet opening should be provided. Therefore, it is convenient in the case of the embodiment shown in FIG. 2 having the inclined container, to dispose the axes of the high speed tools 4 in the upper zone of the container.

The high speed tool 4 can be raised, lowered and pivoted by the tool carrier 20. By the pivoting movement of the carrier, the distance between the toothed discs 3 and the wall of the container 1 can be maintained constant even as the toothed discs become smaller due to wear. Furthermore, this pivoting movement offers an opportunity, in the case of intermittent charging of the apparatus, if for example relatively large quantities of material are suddenly fed, of moving the shaft of the high speed tool 4 by automatic control means and using hydraulic pivoting apparatus, and the toothed discs 3, at a greater distance from the container wall, so that non-uniform layers of material can be passed between the container wall 1 and the toothed discs 3 without any shock loading of the drive elements. As pulverization proceeds, the distance between the toothed discs and the container wall can be successively reduced. This increases the insensitivity of the machine to hard and lumpy foreign bodies.

The pivoting movement of the tool carrier 20 futhermore makes it possible to pivot the high speed tool 4 into the region of the opening, not described in greater detail, disposed at the upper edge of the container 1, and to utilize an arrangement whereby after a few screwed connections have been undone, the tool 4, together with the toothed discs 3, 3', etc., can be withdrawn from the machine and quickly exchanged for a second tool which has sharpened toothed discs.

Figure 2:
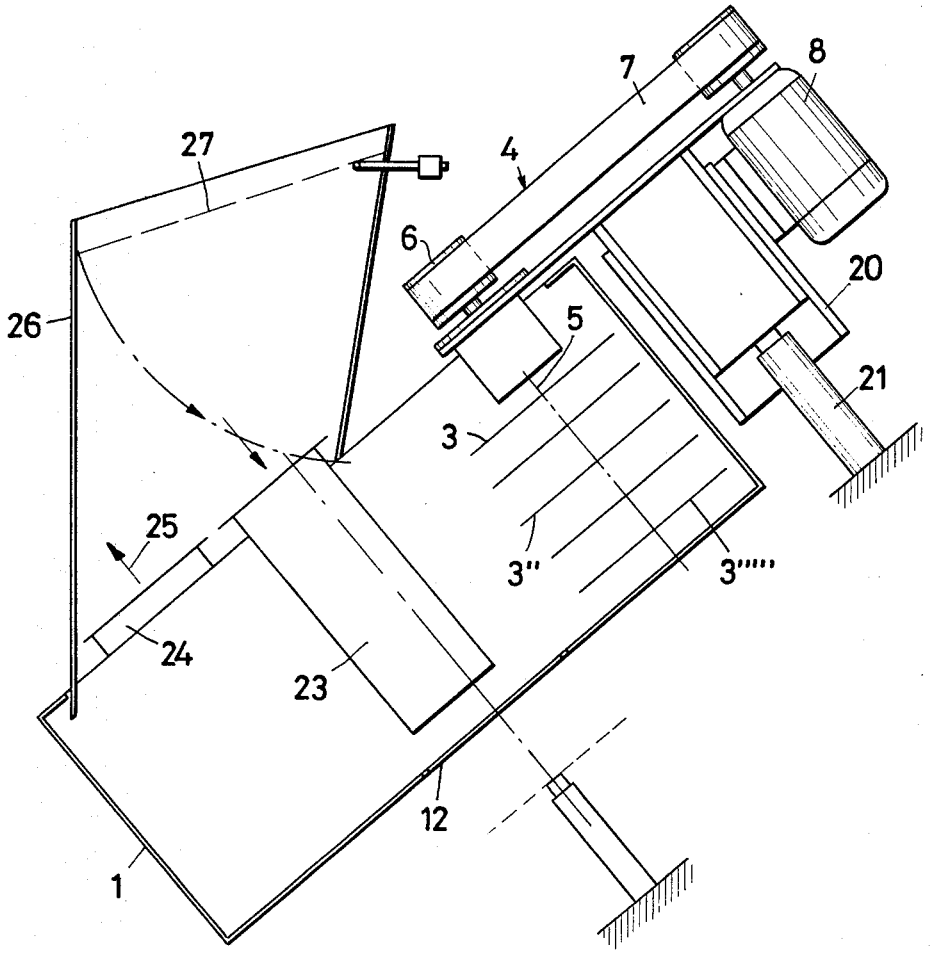
FIG. 2 is a sectional view through a special embodiment of pulverizing apparatus according to the invention with the container axis tilted with respect to the horizontal.

FIG. 2 shows the pivot 21 disposed outside the container 1 and carrying the tool 4 together with the driving motor 8. By periodic raising and lowering of the pivot 21 by means of a small hydraulic ram, it is possible for the toothed discs to cover the overall height of the side wall of the container. If the machine is equipped with more than one high speed tool 4, generally the raising and lowering movement of the tool shaft will be adequate to process the material and to clean the container wall. Thus, a constant shifting of the material being processed is achieved, so that the toothed discs of the other tools which are not vertically adjustable will constantly engage new layers of material.

If it is intended, in the case of periodic operation, to discharge the treated material through the container orifice 12, the container 1 is switched to a sub-critical speed during the emptying process. The toothed discs 3 then clean the container wall of any material still clinging to it. The deflector 14 ensures complete discharge of the contents in a few seconds.

Although the embodiment shown in FIG. 2 is shown with the container 1 steeply inclined with respect to the horizontal, and since experiments have shown this to be preferably, the invention is of course not limited to this arrangement.

The hydraulic apparatus 22 shown diagrammatically in FIG. 1 so pivots the tool carrier 20 that the high speed tool 4 is moved, from the upper position shown in solid lines into the low position shown in broken lines. By reason of the radial component, therefore, it becomes readily possible to move the high speed tool 4 towards and away from the container center 10.

It is important to note the opposite direction of rotation of the container 1 according to arrow 9 and of the high speed tools 4 according to arrow 13 in FIG. 1.

FIG. 2 shows the automatically opened and closed discharge orifice 12 disposed in the container bottom and which is shown in broken lines in the open position. Optionally, it is possible furthermore to provide a feed line 23 extending to deep down to the bottom of the container 1 and a suction pipe 24 at the top, on the container aperture. In the case of dry grinding non-bulky material, the machine ideally operates continuously. The fines are extracted from the streams ejected by the toothed discs in the direction of the arrow 25, through the suction pipe 24. Materials which are not suitable for vacuum extraction, particularly moist and wet materials, are discharged through the bottom orifice 12. In this case, the device for air supply and discharge need not be provided. Nor need the air supply line be provided when bulky materials are being processed. For this case, a large in-feed hopper 26 with a swinging lid 27 is ideal.

Shown at the top of FIG. 4 is the hydraulic chucking device 28, the pull rod 29 of which extends through the hollow shaft 5. In the example of embodiment shown in FIG. 4, this carries at the bottom a flange 30, so that the toothed discs 3, 3'', etc., with the associated spacer bushes 31 at the top, are easily accessible and can be locked or released jointly for exchange purposes.

Figure 3:
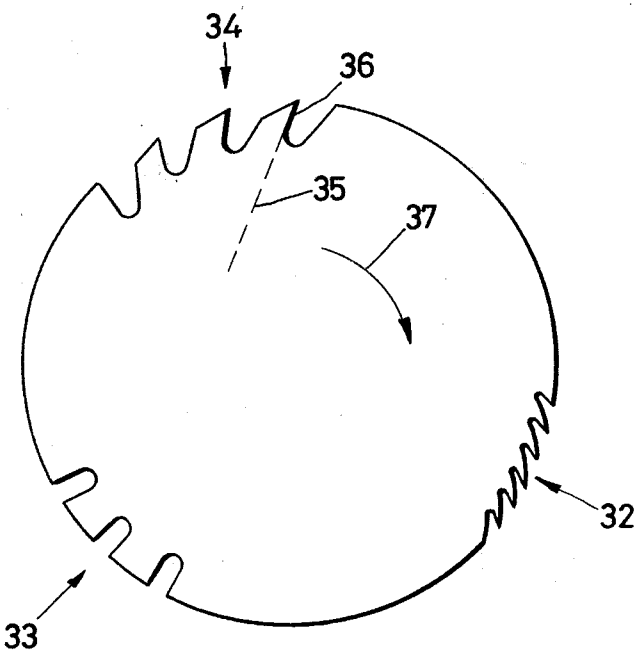
FIG. 3 is a plant view of three special embodiments of a toothed disc.

In FIG. 3, a toothed disc is shown which has three different segments of different tooth shape which may be utilized singly or with other similar discs. The fine tooth shape 32 is unaffected particularly by large metallic foreign bodies, e.g. flat irons which may be present in refuse. However, this shape does produce rapid tearing-open and pulverising of bags, cartons and similar large parts. In the processing of timber or similar materials without a hard material content, sharp teeth are used such as are shown for example at 33 or 34. Toothed discs with radial slots 33 are very simple both to produce and maintain. Once the cutting edges which are used have been worn, it is sufficient to turn the toothed disc over and the cutting edges which were previously not operating will engage the material.

In the case of the tooth form in group 34, the broken line 35 denotes that the actual impact face 36 (the cutting edge described above), is disposed radially in the lead when the direction of rotation is that indicated by the arrow 37.

Figure 5:
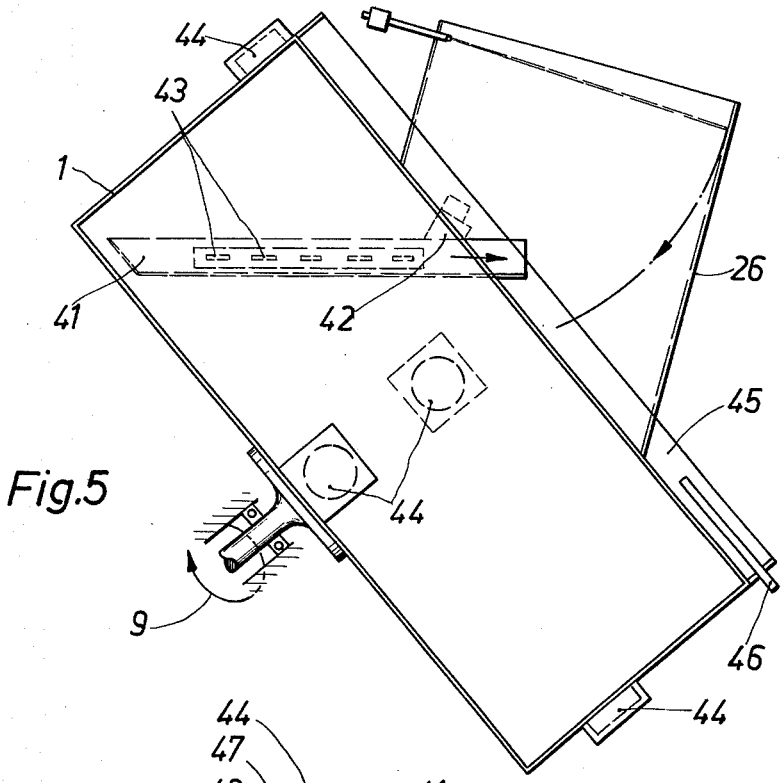
FIG. 5 is a side view of another embodiment of the device shown as a precomminuting machine with magnetic separation.
Figure 6:
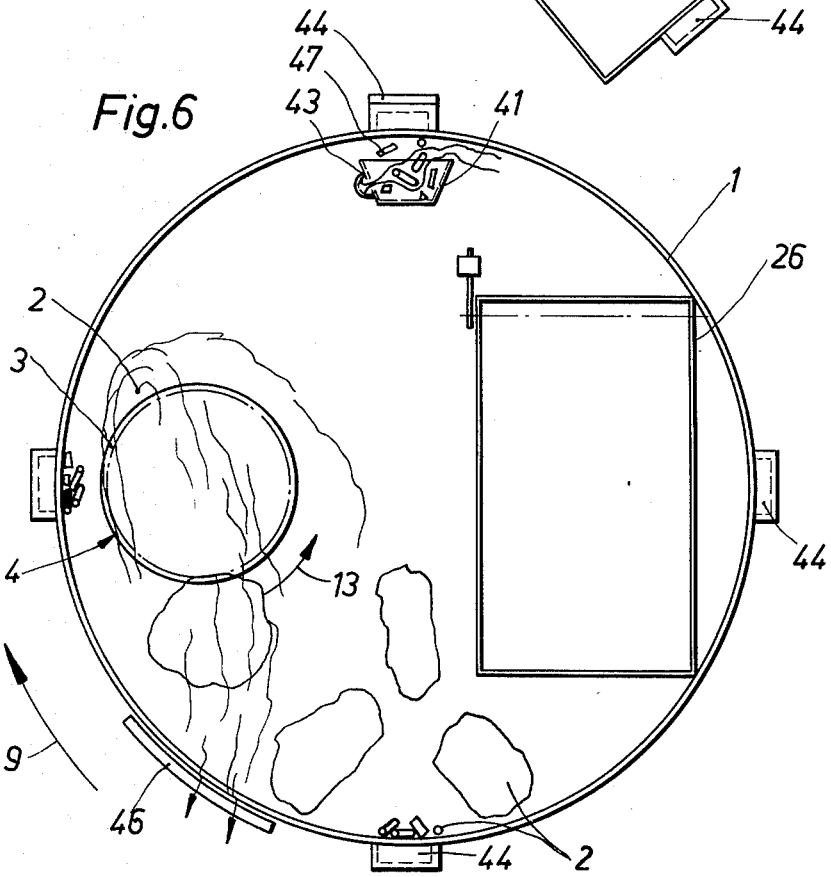
FIG. 6 is a plan view of the embodiment of machine shown in FIG. 5.

FIGS. 5 to 8 show a similar but different embodiment of pulverizing apparatus according to the invention, FIG. 5 showing the rotating container more steeply inclined, i.e. more intensely tilted with respect to the horizontal. Furthermore, compared with the forms of embodiment shown in FIGS. 2 and 7, the view in FIG. 5 is indeed the same in principle but the inclination is a mirrored opposite. The form of embodiment shown in FIGS. 5 to 8 is intended particularly for pulverizing, with a magnetic separation phase. The container 1 is therefore in this case driven at a below-critical speed and rotates in an anti-clockwise direction, as indicated by the arrow 9. The high speed tool 4 according to FIGS. 6 and 7 can be constructed in a similar manner as previously described in connection with FIGS. 1 to 4. Another embodiment of the circular disc is to be described in greater detail later with regard to another embodiment shown in FIGS. 9 and 10. The high speed tool 4 rotates indeed about its shaft 5 but, for the rest, like the magnet 46, it is stationary, while the magnets 44 disposed on the walls of the container 1 rotate with the latter. FIGS. 5 and 6 show that here magnets 44 which are in each case staggered at 90° with respect to one another are, also as shown in FIG. 5, staggered in their height with respect to one another, over the total height of the container wall, and they may be either single magnets or double magnets, as mentioned at the outset. In either case, they are so fitted into the container walls, in non-magnetic plate, e.g. VA steel, that a relatively smooth transition is created on the inside. As the container 1 rotates, the material being treated, which is constantly turned over and in motion, passes constantly through all four magnetic fields. As a result, during the course of pulverizing, ferrous metal parts can very reliably be picked up by a magnetic field, carried to a raised point above the discharge chute and let drop into it by the magnets such as electromagnets (not shown) being switched off. If plastic film, shreds of paper or textiles are held between iron parts and the rising magnet 44, they will be blown out through orifices 43 disposed in the sides of the discharge chute 41 or will be blown out by passing a stream of air flowing through them, and thus will not pass into the discharge chute 41. The metal parts which on the other hand then lie in the discharge chute 41 are passed out either by a vibrator 42 (as shown in FIG. 5), by an even steeper inclination than in the embodiment shown in FIG. 5, or in some other manner in the direction of the arrow shown in the discharge chute 41. It will be appreciated that the discharge chute 41 does not collide with the intake funnel 6, because it expediently disposed at the side, as shown for example diagrammatically at the top in FIG. 6. This also shows the streams of air flowing out of the orifices 43 and carrying paper shreds. Reference 47 at the top in FIG. 6 denotes a scraper device which may be used for removing the metal parts 2 shown in the drawings and which are part of the material 2. Instead of the scraper 47, it is possible also to provide a round brush or other suitable apparatus. These scraper means 47 can be omitted completely if it is adequate for the ferrous metal parts picked up to be allowed to drop into the discharge chute 41 simply by the electromagnets being switched off.

FIG. 6 shows at the bottom four diagrammatically indicated refuse bags which, after colliding with the toothed disc 3 which is rotating in the direction of the arrow 13, are cut open and then, in more dispersed form as indicated by the serpentine lines in FIG. 6, they drop by gravity into the bottom part of the container 1.

FIG. 5 shows that the upper rim 45 of the container consists of non-magnetic material over the whole periphery and adjacent the lower zone of said container rim, a fixed elongated curved magnet 46 is disposed. Then, if tin cans which emerge when the refuse bags are torn open, remaining on top of the layer of material 2, attempt to roll downwards and over the edge, then they must do so through the field of the magnet 46, which holds them fast on the rim 45 and thus carries them upwards into the region of the toothed disc tool shown on the left in FIG. 6. Either they have already been picked up in the meantime by another revolving magnet 44 or they pass lower down into the layer of materials 2, so that in any event they are prevented from rolling down the surface again and cannot be passed over the rim 45 without being processed in some way.

Figure 7:
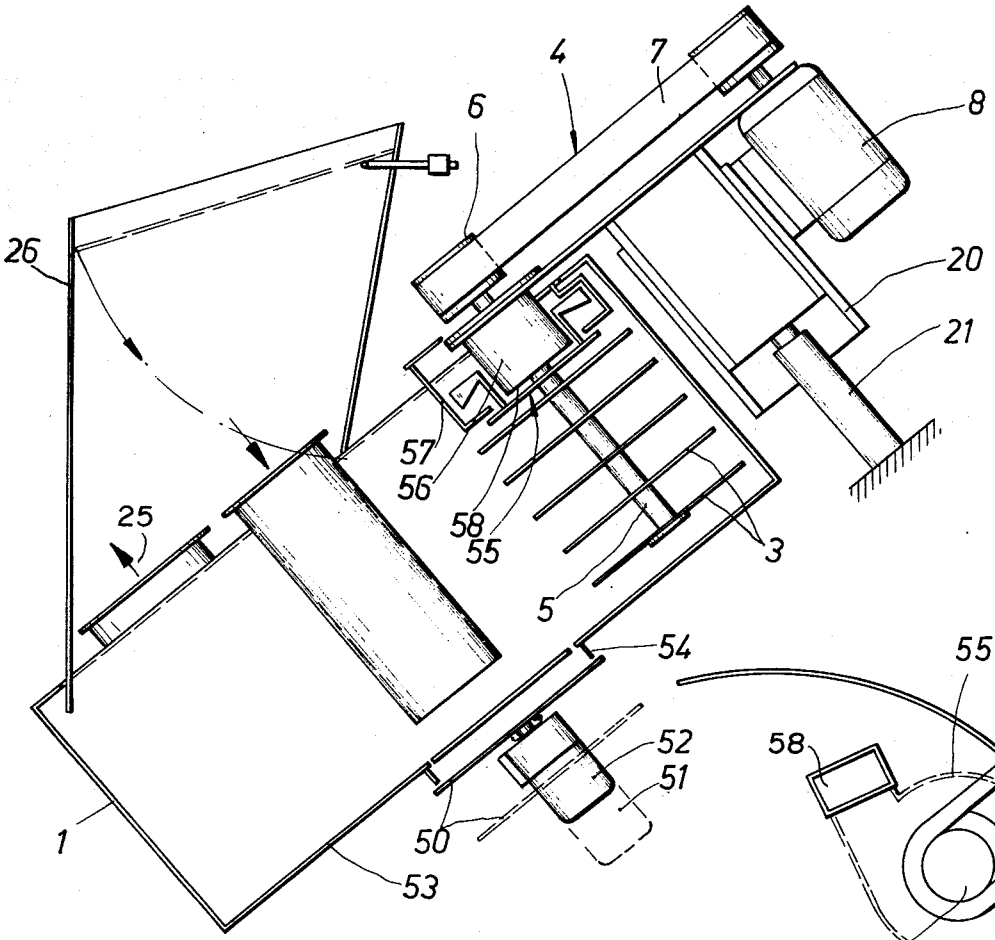
FIG. 7 shows a further embodiment of comminuting apparatus according to the invention, in a view similar to that in FIG. 2 but with a fan disposed above the toothed disc tool and showing more clearly the discharge orifice with the rotating cover.
Figure 8:
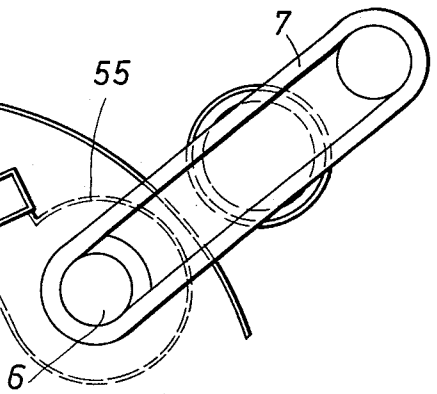
FIG. 8 is a broken away plan view of the right-hand upper part of the apparatus according to FIG. 7.

If the apparatus shown in FIGS. 7 and 8 is used as a fine pulverizer, in which the container 1 is again caused to rotate at above-critical speed, then the discharge of dry pulverized material can either take place in the already-described manner, in the direction of the arrow 25, or, between the toothed discs 3 shown in FIG. 7 and the bearing of the toothed disc tool or beneath the V-belt pulley 6, a fan 55 is disposed, the impeller 56 is mounted on the shaft 5 of the toothed disc tool 4. The housing 47 of the fan 55 is mounted on the tool carrier 20 of the V-belt drive 6, 7, 8 and the blown-out jet extends approximately at right-angles to the shaft 5, as can be seen from FIG. 8 and the position of the opening for a fan 55 which is shown therein. On the other hand, in the case of the embodiment shown in FIG. 7, there is on the intake opening 58 for the fan 55 a throttling arrangement, not shown in greater detail, since throttling of the fan 55 expediently takes place on the intake side.

For the continuous working also of other than dry and powdered materials, it is possible to provide in the middle of the container bottom 53, on a connector 54 disposed rigidly thereon, a cover 50 which is not rigidly connected to the connector 54 or the container bottom 53 but is driven by a separate motor 52 at a separately controlled speed, being mounted on the shaft 51 thereof. Preferably, this speed is so adjusted that the cover 50 rotates at a speed which is slightly greater than that of the connector 54 or the container bottom 53. In FIG. 7, the cover piece 50 shown in a solid line is pressed on the connector 54, in order to keep the inlet aperture closed. On the other hand, in the broken-line position, the cover 50 — exaggeratedly drawn — is at a distance from the connector 54. For batch-wise operation, this distance is not exaggerated; instead, it is intended that as much material as possible should emerge quickly. With continuous operation, on the other hand, the distance from the free edge of the connector 54 to the more rapidly rotating cover 50 should be adjusted so that it is so small that just the desired quantity of material, comminuted to the desired degree of fineness, emerges continuously at the bottom.

Figure 9:
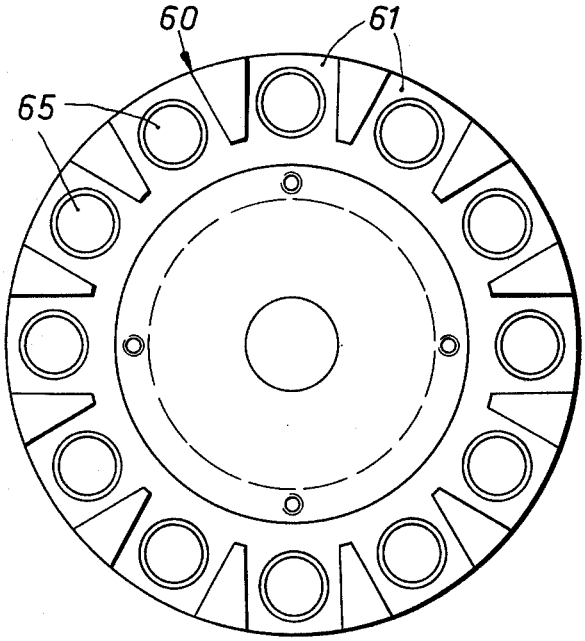
FIG. 9 is a plan view of a special embodiment of a bottom carrier disc for another type of toothed disc.
Figure 10:
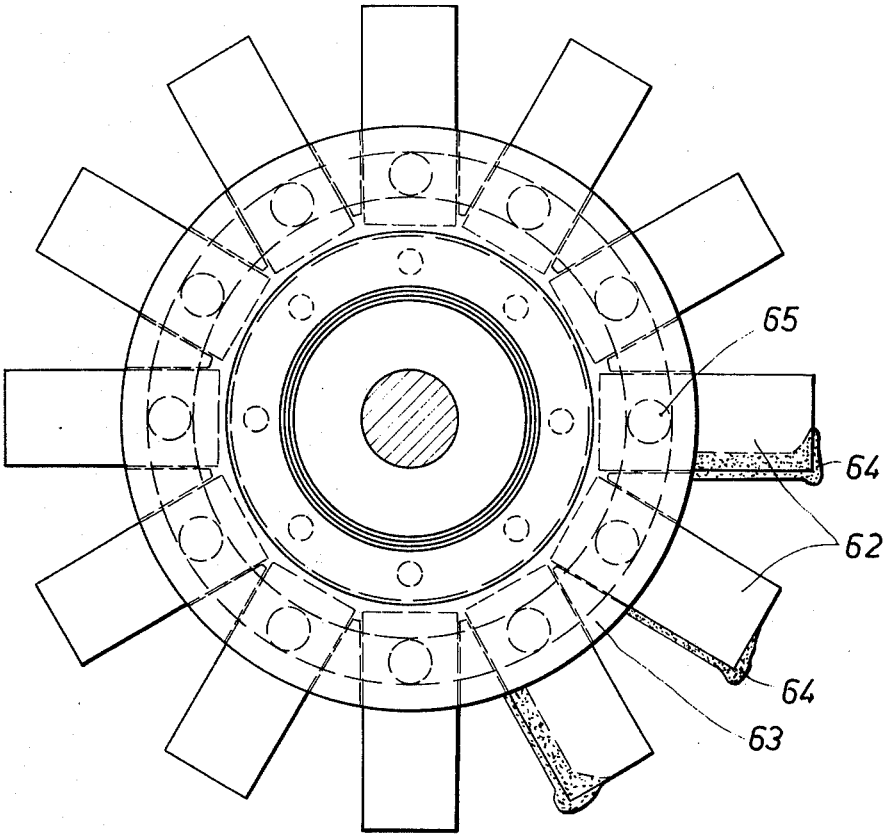
FIG. 10 shows the embodiment of toothed disc provided by means of the carrier disc according to FIG. 9 and having flat rectangular plates which are armored in places.

According to the embodiment shown in FIGS. 9 and 10, the toothed disc is differently constructed from that shown in FIG. 3. It consists of a bottom carrier disc 60 having radially disposed cut-outs 61 into which the teeth 62 are plate-shaped, are inserted and secured by bolts 65. The bolts ensure attachment of the plate-like teeth 62 in a radial direction and the edges of the cut-outs 61 prevent tilting in a peripheral direction, so that even though the cut-outs are made or beaten out with substantially no tolerances, there is no disadvantage. After fitment of the teeth 62 into the cut-outs 61, a cover disc 63 is placed on top and secured by means of screws. The ring of screws disposed above the periphery can be clearly seen in FIG. 10, although it is not identified by a reference numeral. The armoring of the plates is indicated at 64.

The action of centrigual force is advantageously aimed in two directions:

1. The bulky materials which are to be finely comminuted are, without further preliminary treatment, first introduced into the container of the pulverizing apparatus and are automatically pressed against the inside wall of the container by the high rate of revolution (at first, the materials in question here are those which require no magnetic separation or preliminary comminution). As a result, these materials are held fast against the rotating container wall and, at the peripheral speed of the container, they are fed into the high speed tool which rotates about its own axis but which is otherwise stationary. In this way, engagement is reliable and high comminuting efficiency is transmitted, because the speed of revolution of the container is relatively high.

2. In order to obtain a certain degree of fineness of the comminuted material, further comminution may take place. Fine grinding is only advisable and effective if sufficiently powerful pulses can be transmitted to the material to be comminuted. These are shocks which load the particles beyond their breakage limit. However, with increasing degrees of fineness, the mass weight of the already pre-comminuted particles becomes increasingly smaller, so that the pulse, and the product of mass x velocity, likewise greatly diminishes. Consequently, the comminuting effect also diminishes. Surprisingly, the already pre-comminuted particles of low stationary mass, are by reason of the measure according to the invention, namely, by reason of centrifugal force, they are so pressed against the container wall that they cling thereto at a multiple of the earth's acceleration. Thus, their mass weight is artificially increased and in turn the transmission of a high pulse for further ultrafine comminution of the particles is guaranteed.

The pulverizing apparatus according to the invention is suitable for virtually all materials, particularly for the processing of the substances mentioned at the outset, both powdered and sand-like, dry as well as moist and also sticky compositions, such as, for example, clay or clay mixed with pieces of chalk, fabrics, shoes and other viscous materials being readily pulverized. The machine according to the invention reduces the material by cutting, shredding, tearing, beating, squashing and by abrasion. In the case of a material such as refuse which is composed of basically different materials, this versatile functioning with a very simple and effective apparatus is of decisive significance. Proportions of hard material in the waste, such as for example glass, china, etc., are required to be reduced to the granular size of fine sand, while it is sufficient for rottable materials to be reduced to 10 mm and downwards. The container mentioned at the outset may be smooth walled or may also be produced from perforated or ribbed plate. It is necessary only to avoid relatively large raised portions on the wall surface.

In other words, pulverizing occurs in that, according to the invention, the container is driven at an over-critical speed, the direction of rotation of the high speed being opposite to that of the adjacently disposed container wall so that the material present in the more or less large gap between the container wall and the periphery of the toothed disc is thrown out and not into this gap, which might damage the machine.

According to the invention, it is furthermore advantageous for a plurality of toothed discs to be mounted on the shaft one above another and at a distance from one another so that the material pressed against the container wall remains like a roll at the height of the intermediate space. It is always desirable to maintain a considerable difference in speeds between the material held and pressed against the container wall and the tool engaging this material, i.e. the circular toothed disc, in order to transmit the highest and most intensive pulses possible to the material which is to be pulverized. The aforementioned measure of mounting a plurality of toothed discs on the shaft at a distance one from another is logical particularly if, according to the invention, the shaft of the high speed tool is displaceable in an axial direction. In this case, in a first position, as many zones of goods on the container wall can be covered in annular strips as there are toothed discs mounted on the shaft. In a continuous operation, the shaft is moved axially by a certain length in slow rhythm and the desired high difference in speeds between tool and material is ensured when the material remains in a roll along that annular strip which is not so covered. The axial upwards and downwards movement of the tool shaft occurs uninterruptedly, so that the entire inside wall of the container is completely covered by the toothed discs.

Furthermore, according to the invention, it is expedient for a plurality of high speed tools to be disposed eccentrically in the container. Then the comminution of bulky waste materials such as packaging material, plastics containers, pieces of rubber, shoes, tubes, papers and cartons of all types, bundled and loose, will be completed particularly quickly in the machine. The pulverizing apparatus according to the invention works perfectly in any range of consistency. In the case of fine grinding, i.e. at that condition of operation where the container is driven at above-critical speed, it is certainly essential that the direction of rotation of the toothed disc be opposite to that of the adjacent container wall, as already mentioned at the outset.

Otherwise, the material will cling between the tool and the container, or become clogged and the tool shaft will be overloaded.

According to a further embodiment of the invention, for the purpose of pre-comminution, the container is drive at below-critical speed, i.e. the number of revolutions per minute at which the container is driven is so small that the weight of the material is greater than the centrifugal force which seeks to press the material against the inside wall of the container. The below-critical speed is used either in a separate machine which, for the purpose of pre-comminution, is disposed alongside the fine pulverizing machine, or the speeds are changed in one and the same machine. In any case, where pre-comminution is concerned, during which the materials still have a relatively large mass, it is possible to achieve a breaking-open of the parts, a kind of coarse sawing and, for example in the case of household refuse, certainly a tearing open of bags, cartons and sacks. Even if outwardly dried refuse sludge is being treated, lumps are destroyed and broken down so that, in principle, homogenization occurs to a certain degree. All this occurs under conditions of economic energy consumption and preferably a plate with a relatively broad or high container wall is used which, according to a further feature of the invention, is tilted, i.e. inclined more or less steeply, with respect to the horizontal.

Such inclined plates are known in granulation technology. At approximately half the height of the rising half of the plate, there is a rapidly moving tool having at least one toothed disc and in the case of larger installations, it is possible also to use a plurality of these tools. These rotate at moderate speed in the opposite direction to that of the container. Bundled paper which was hitherto left on the heaps of debris from incineration plants, frequently in just an outwardly charred condition, is reliably torn apart so that the material, particularly bundled and compressed materials, are accessible to the combustion air at all points.

Furthermore, the invention is characterised in that, rigidly mounted on the container is at least one magnet, the active side of which, facing the interior of the container, is disposed in the regularly curved face of the container wall, and in that a discharge chute is provided in the container. These measures apply to magnetic separation. At the commencement of the pre-comminution, when, while the container is inclined, the shafts of the high speed tools with the toothed discs are disposed at a greater distance from the container wall, even large-bulk materials can be fed into the apparatus. After separation of the iron materials and continued comminution, the distance between the toothed discs and the container wall is diminished by the aforementioned pivoting, towards the container wall, possible to the extent of fine decomposition.

Where a plurality of toothed disc tools are disposed one after another in a container, as found in larger machine units, the distance from each toothed disc tool to the wall of the container is so regulated that the driving motors of the individual toothed disc tools operate with the same loading. This means that in the vicinity of the material intake, the toothed disc tools are at a greater distance from the container wall than those which follow.

The utilization of at least one magnet on the container - preferably in the region of the other magnet, via a magnetically insulating material overcomes the difficulties which have hiterto been encountered in magnetic separation. The known over-belt magnets are namely either disposed (for magnetic separation) very closely over the material which is for example passing through on a belt, so that larger pieces such as large cans, bottles, buckets, cartons, etc., cannot pass through and strike the over-belt magnet or, on the other hand, their distance from the material to be processed is so great that the magnetic force is not sufficient for separation. In any case, disturbances in operation occur and such disturbances do not any longer arise with the apparatus according to the invention. In fact, by reason of the improvements according to the present invention, it is advantageously ensured that the material to be processed positively passes through a large number of magnetic fields which may be disposed in close sequence, in the shortest of time, during co-rotation with the rotating container, the material being simultaneously subject to lively movement. Beginning with a slight circulation, this movement can be pursued to the point of breaking down large lumps, of viscous and hard agglomerates in the most widely diverse degrees of fineness, the materials fed in being at the same time mixed, the thoroughness of magnetic separation achieving optimum levels even in the case of short treatment times. Also, a throughput of large quantities is guaranteed.

According to a further development of the invention, two or more, preferably four, magnets which can be switched off are disposed on the periphery and/or are evenly distributed over the height of the container wall. Preferred are electromagnets which have given the best results in tests. The effect of these electromagnets is particularly strong if two coils are disposed one closely after the other in the direction of rotation of the container, in each case with an iron core and with a yoke in the form of an iron plate or the like connecting the two serially disposed cores. Then also the magnetic fields extend from one pole to the opposing pole, more or less in the direction of rotation of the container, and the force of attraction for ferrous metals in the material which is to be treated is very great. Ideally, then, the toothed disc tools, viewed in the direction of the conainer wall, are disposed between two double magnets so that those iron parts which are trapped by the magnets during rotation do not or do not often enter the working range of the toothed disc tool. Also, a larger area is covered by using the double magnets described.

In the case of a special embodiment, while retaining the smooth inner face of the container wall, it is possible to use a plurality of electromagnets which are moved to the height of the container wall and which are also disposed at a distance around the periphery of the container wall, so that virtually the entire wall of the container is, during rotation at below-critical speed, covered by at least one magnetic field. If the container runs for example at 25 revolutions per minute, then the basic period of dwell of the material in the container is only 30 seconds and, with four magnets disposed cross-wise, the material to be treated passes through 50 magnetic fields in this time. In the upper zone of the inclined rotating container, the non-magnetic material drops downwards, whereas the iron parts picked up by the magnets are carried on and are conducted to a definite place on the descending side of the half plate. There, they are either held back by a wall scraper so that the magnetic plate slides past, whereupon the ferrous metals drop into the said delivery chute disposed underneath, or the magnet is switched off briefly at the discharge point so that the wall scrapers are then unnecessary. The iron parts drop into the discharge apparatus during the period of switch-off, so that the separated metals can be carried away by reason of the inclined position, by a conveyor belt, by a vibrator or the like.

A pre-pulverizer and iron separator according to the invention is completely unaffected by coarse parts and cannot clog even if unevenly loaded, even if coarse-lump material enters the machine, because the inside wall of the container is smooth, the aperture is exposed and discharge can take place without hindrance.

The machine according to the invention also makes it possible to conduct finely ground material through a multiplicity of strong magnetic fields in the moving stage, in rapid sequence and for an exactly adjustable time. It is particularly convenient to use the machine according to the invention for magnetic separation from materials which are sensitive to iron contamination, such as for example raw materials in the fine ceramics industry. Reliable separation of even fine steel particles provides considerable advantages because, for example in the fine ceramics industry, it is possible then to use steel grinders, particularly since the iron impurities caused by abrasion can be removed again by the machine according to the invention. Also in the chemicals and in other branches of industry, similar advantageous possibilities of application arise.

For clean magnetic separation of even fine iron particles, it is according to the invention expedient to provide over the discharge chute and next to the inside wall of the container a scraping device, e.g. a wall scraper and/or round brooms. These can then provide for a clean elimination of the iron parts separated, so that high grade cleansing is guaranteed in a very economical fashion. Furthermore, by reason of the measure of the invention, it becomes possible to provide alongside the discharge chute a fan and blow-out orifices to produce an air stream which will pass over the discharge zone, and also an opportunity of so conducting the stream of air that paper and plastics shreds, etc., which may be clinging to the iron parts are blown to one side as the material drops when the magnets are switched off, so that these shreds do not penetrate between the separated iron parts.

According to the invention, it is advantageous furthermore to provide in the bottom of the container a discharge orifice which can be closed by a cover. For example, after a 1 m long sticks of young spruce, with branches and twigs and bark, have been reduced to fibres of about 1 to 5 mm, it is possible in per se known manner to lower a deflecting apparatus from the upper aperture in the container down to the bottom and which, within an extremely short time, will discharge all the comminuted material when the discharge orifice is open. The apparatus is then ready for the next batch, once the discharge orifice has been closed.

According to the invention, it is also advantageous to provide on the shaft a separate motor for the continuous operation of the cover and for this preferably to be driven at a speed in advance of the container bottom. In this respect, continuous withdrawal is possible even without vacuum extraction of the fine material upwards, a system which will be described hereinafter. When the empty machine is started up, the orifice contained in the middle of the container bottom is closed by the aforesaid cover being fitted. As soon as a quantity of material sufficient for continuous operation is present in the container, the cover is pushed downwards in the direction of the axis of the rotating container, so that a discharge gap is created between the container bottom and the cover. At this setting, a continuous stream of material surprisingly flows out of the machine, the degree of fineness of the material processed being very high. Thus, inside the container there is an excellent separation of coarse from fine matter. The cause of this separation possibly resides in the rapid circulation of the discharge stream generated by the toothed disc tools. Strong centrifugal forces act within this discharge stream, so that coarser and heavier parts at once move into the outer zone of the plate, where they are subjected to further comminution, while the finer parts move towards the center of the plate where they are discharged. Measured in relation to the container bottom, the cover mounted on a small geared motor or the like rotates positively at advancing speed. In this way and particularly by reason of the further measure according to the invention whereby, viewed in the direction of material discharge, the cover is disposed after a connector which is fixed on the outside of the connector bottom, while on the cover there is at least one curved delivery rib of little height, it is completely ensured that there will be no blockage in the delivery gap. In this way, it is possible even to discharge sticky and plastics compositions, particularly by virtue of the curved delivery rib which is preferably provided and which conducts the material which arrives from above, reliably outwards through the gap. There are outstanding possiblities of controlling the quantity discharged, namely on the one hand by adjustment of a desired width of gap between the cover and the container bottom and on the other by the rotary speed of the cover. Discharge downwards also reliably avoids inadequately comminuted plastics residues being discharged. All this although the machine according to the invention operates on minimum expenditure; even in the case of fully-automatic operation of the plant, during which the discharge orifice is so regulated that the material being discharged is of the desired fineness.

In the case of another form of embodiment, for continuous operation with dry or nearly dry materials, a suction pipe, a supply line and a covering are provided on the upper container aperture. The supply line is preferably disposed in the middle of the container and extends far down, almost to the container bottom, so that the air streams are evenly and intensively charged with material and for purposes of centrifugal separation are, if at all possible, caused to rotate. When the material to be comminuted has attained the sufficiently small particle size, it will, after impact and comminution, by which the particles are briefly separated from the container wall, briefly remain in the space within the container. When they are sufficiently small, their weight is so minimal that they can be extracted by the stream of air. Otherwise, they are again pressed against the container wall by centrifugal force. Thus, it is advantageously possible on the one hand to feed material through the supply line for comminution and, on the other, automatically to sort the comminuted material according to particle size and to extract it upwardly through the vacuum tube.

A further advantageous embodiment of the invention is characterised in that between the toothed disc or discs and the bearing for the shaft carrying the toothed disc, there is a fan, the impeller of which is mounted on the shaft, its housing being mounted on the tool carrier of the V-belt drive, and the blow-out stream from which extends more or less at right-angles to the shaft, and in that a throttling arrangement is provided on the intake aperture of the fan. Then, the blow-out stream from the fan is directed more or less at right-angles to the axis of the toothed disc tool. With the throttling device, it is possible to adapt the quantity of air to be extracted, to the particular conditions of operation obtaining. This fan can also be operated as a grader (more or less according to the principle of the transverse flow grader), by providing in the vicinity of the intake aperture a rotating disc which generates a stream of air directed at right-angles to the axis of the toothed disc too, so that the rising air, charged with ground material, has to traverse this transversely directed lighter air stream, whereby heavier parts entrained by the rising stream of air are deflected outwardly by the transversely directed air stream and then fall back into the interior of the container.

A special embodiment of the invention is advantageously constructed in that in the outer zone, the toothed disc has a thickness of 2 to 12 mm, preferably 2.5 to 8 mm, and possible a diameter of 100 to 900 mm and preferably 300 to 750 mm. In the case of very large machine units, these dimensions are greater. From the point of view of grinding efficiency, high peripheral or differential speeds are favorable, particularly in the case of material which has to be broken down finely. The more rapidly the particles are loaded beyond their breaking limit, the higher is the efficiency of the machine. As already mentioned, the diameter of the container depends upon the size of the machine. Important is the peripheral speed of the discs which, for fine comminuation, is around 70 to 120 m/sec in the case of smaller machine units, although for special jobs, it may be higher. In the case of pre-comminution and coarse preparation, the peripheral speeds are between ¼ to ½ of the values mentioned. The cost of power for loadings which do not result in breakage is substantially or completely lost and therefore the measures according to the invention are so contrived that the particles are loaded beyond their breaking limit. The material to be comminuted can, by reason of the apparatus according to the invention, be subjected to extremely high loadings. In practice, the upper limit is determined by the edge life of the materials used for the tools.

According to the invention, therefore, it is expedient for the relevant impact face of the teeth to be disposed radially or projecting with respect to the toothed disc. For high loadings or in order to increase the edge life, the impact faces may also be armoured. In the case of one embodiment of the invention, the form of the teeth on the toothed circular disc lies between the shape used for wood saw blades and that used for circular metal saw blades. In the case of another embodiment of the invention, it has been regarded as convenient for the toothed disc to have a carrier disc underneath it, with radially disposed cut-outs, teeth which can be inserted in these latter and attached to the carrier disc, and a cover disc disposed on top. In this way, the teeth which are fitted securely for example by bolts, and then clamped in position via the two discs (carrier disc and cover disc), can be exchanged individually as minor components.

According to a further suggestion of the invention, the teeth may consist of rectangular flat plates which are preferably armored in places. The pulverizing process takes place substantially at the cutting edges and edges of the impact faces, so that surprisingly the action of the pulverizing apparatus could be enhanced by these narrow toothed discs. The excellent suitability and surprising technical action of the high speed rotating toothed discs according to the invention, for the pulverizing of materials of basically different consistency, is based on the combined effect of cutting, shredding, sawing, tearing, squashing, abrading and comminution by shock and/or impact loading on the material being treated, i.e. by hammering. The toothed disc according to the invention unifies these combined working and attack effects better than any other pulverizing apparatus. Therefore, the machine according to the invention is so surprisingly suitable for all manner of materials, while the known machines are always designed just for definite fields, grades, jobs or quantities.

According to the invention, what is essential is the surprising fact that the container wall and thus the shaft of the high speed tool is made relatively high and/or long, in order to achieve a high rate of throughput in the machine. If for example the wall height of the container is equal to the radius of the container, then the pulverizing apparatus according to the invention can process twice the quantity than could be processed if only a plate mill were to be used in which treatment occurs substantially only in the bottom of the plate-like container.

Many grades of material for grinding, particularly synthetic plastics, nutrients, chemicals and combustible materials are very sensitive to rises in temperature. The currently most used other grinding systems which operate continuously concentrate the loading on the relatively thin stream of material into a short time, so that the heat released cannot be dissipated rapidly enough and therefore produces very dangerous rises in temperature in the material being ground. In the machine according to the invention, on the other hand, a relatively large quantity of material is always present. The particles picked up by the pulverizing tools are immediately subject to a stream of cooling air and cooler adjacent particles. In this way, the particles are immediately cooled to the average temperature of the material present in the machine. The average temperature can easily be controlled by the quantity of air circulating in the machine, the number of toothed discs in engagement, the quantity of material being ground and possibly the use of additional coolants prior to charging or in the machine; yes, even the inclined position of the rotating container can have an influence.

It was mentioned above that the direction of rotation of the toothed disc tools is generally opposite to the direction of rotation of the container. On the other hand, should the problem be posed of opening up material consisting of smaller particles, in a fibre-protective manner, then as few fibres as possible should be undesirably shortened by impact or pronounced shock effects, then synchronism of container with toothed disc at greatly differentiated peripheral speeds will be advisable. By this method, it is possible protectively to open up for example timber, asbestos rock, textile waste, etc., in order to obtain long fibres. By reason of the above critical rotary speed of the container during fine comminution, the material to be opened up is practically held fast by the force of centrifugal action, while the toothed disc tools provide for a cutting action.

According to the invention, it is furthermore advantageous for the outer free edge of the container, over its entire periphery, to consist of non-magnetic material and to provide a stationary elongated magnet in the lower zone of the inclined container. Surprisingly, this can prevent lightweight, bulky metal parts rolling off over the edge of the container before they are picked up by the magnets. This possibility arises then if a high layer of predominantly non-magnetic material is present between the magnet and the supply of material. The non-magnetic material at the outer edge could be VA steel. The said magnet is rigidly disposed at the discharge point directly below the rotating edge of the container and is spaced at a small distance therefrom. An outwardly rolling iron body then passes positively into the field of this magnet and is trapped on the rotating wall over the length of the fixed magnet disposed underneath. During this movement, the iron body passes out of the stream of material being discharged. At the end of the magnetic field, as soon as no material is pushing its way on from behind, the iron body falls back into the container and is then, in the desired manner, picked up by the next co-rotating magnet and is carried to the upper discharge point.

Furthermore, if the apparatus according to the invention is used as a pre-pulverizer, it is possible additionally to connect over the outer edge of the rotating container a screen edge so that the outflowing material first passes through the screen edge. Thus, the fine components would be separated off, while the coarser constituents flowing over it would be fed into the fine pulverizer. The material flowing out of the pre-pulverizer will in fact always contain a more or less large proportion of fine grain components which require no further comminution. It would be a waste of power to feed these fine particles to a subsequent fine pulverizing machine, the container of which rotates at above critical speed in the manner described. This measure ensures that only the coarser part is carried into the aforesaid subsequent fine pulverizing apparatus.

The screen edge may be cylindrical, circular or even polygonal. In the case of numerous materials, angular drum screens operate more favourably than cylindrical.

In comparison with the known machines for mixing or dressing substances which apply in some cases similar mechanical measures as those proposed according to the invention, attention is also drawn to the essential difference in that where the apparatus according to the invention is concerned, apart from the high speed tool, as a rule no other members are provided in the container, particularly no deflectors which would consume power. The apparatus could only in the case of special constructions be equipped with retractable and extending deflecting arrangements, e.g. for discharging through an orifice disposed in the center of the bottom, or in the case of a container rotating at slow, even though also at over-critical speed. Preferably, thoughts are directed at the very simple embodiment with container and only one high speed tool, whereby advantageously quite considerable free space is available for feeding in even bulky materials. Apart from very hard abrasive substances which are usually not even reduced in size by metal saws, all materials, even ceramic substances, which occur in refuse, can be fed into the machine.

A surprising advantage of the apparatus according to the invention is the attainable increase in quality of numerous products obtained from a plurality of basic materials, e.g. optimum utilization of natural products, particularly those which do not increase in volume. For the first time by reason of the apparatus according to the invention, it is possible to exploit the knowledge that chemical reactions, particularly between solids with and without a proportion of liquid, the best results are obtained if the particle of the starting substances are jointly ground to the highest degree of fineness possible. In consequence, there is a merging of very fine particles which can be compared with a cold welding thereof.

The toothed discs, cutting discs, particular circular saws according to the invention, have proved outstandingly suitable in the cutting and opening up of soft, medium-hard materials and even metals. The high speed rotation of the toothed disc makes it appear very rigid and sharp. Where the processing of liquid materials is concerned, comminution by mechanical shock transmission is further improved by the resultant cavitation, which is likewise caused by the high peripheral speeds.

Also very advantageous is the possibilty of converting to granular form waste products comminuted with the machine according to the invention and blended with binders or other substances, particularly if it is desired to produce lightweight granular additives or pourable moulding compositions from mixtures of waste clay. For these, the pouring capacity is frequently decisive, if only one pourable material is ideally suitable for rapid and regular feeding of moulding machines. The machine according to the invention also resolves this problem in a surprisingly advantageous manner by combining the pulverizing process, the mixing process, combined with accurate attuning of the moisture content, and conversion of the composition into the form of a granulate.

Granulating processes can also be accelerated and intensified by simple measures, using the new pulverizing apparatus. Upon conclusion of the pulverizing and mixing process in the apparatus according to the invention, the rotary speed and angle of inclination of the container are adjusted to those most expedient to granulate production and the high speed tool with the toothed discs is switched over to the same direction of rotation as the container. Ideally, the rotary speed of the toothed discs is also so attuned that there is a slight lead over the container by which an additional rolling movement is imparted to the material which is to be granulated. This is vital to the rapid performance of the granulating process.

In addition, the jet of discharged material produced uninterruptedly inside the container by the toothed discs is ideally suited for heating or cooling purposes. The stream should then be exposed to hot or cold gases.

Where the processing of viscous, sticky compositions is concerned, the amount of energy consumed by the toothed discs can be substantially reduced if, during the working process, the exposed surfaces of the discs are kept wet by being sprayed with liquid or wetting agent. This considerably reduces the friction between the disc and the material being treated and reduces the power consumption without adversely affecting the opening-up effect. In contrast to other preparation machines, the toothed discs according to the invention have only a small part of their surface engaging into the material being treated, so that ideal conditions are created for keeping the surfaces wet with spray jets, so increasing power utilization.

1. An apparatus for pulverizing elastic, viscous and bulky materials, refuse and other waste materials, comprising a high-speed driven container having at least one eccentrically disposed high-speed tool, said tool having a shaft disposed approximately parallel with the axis of the container and provided with a plurality of spaced apart toothed discs the plane of each disc being transverse to the tool shaft and which partially dips into the material present at the container wall, and in that the high-speed tool is radially displaceable in the container and rotates in a direction opposite to that of the adjacent container wall.

2. Apparatus according to claim 1, characterized in that the shaft of the high-speed tool is displaceable in an axial direction.

3. Apparatus according to claim 2, characterized in that a plurality of high-speed tools are eccentrically disposed in the container.

4. Apparatus according to claim 1, characterized in that the axis of the container is inclined with respect to the horizontal.

5. Apparatus according to claim 4, characterized in that at least one magnet is rigidly mounted on the container wall facing the interior of the container, and in that a discharge chute is provided in the container for collecting materials magnetically separated.

6. Apparatus according to claim 5, characterized in that at least two magnets are regularly distributed around the container wall.

7. Apparatus according to claim 1, including a discharge orifice in the container bottom which can be closed by a cover.

8. Apparatus according to claim 7, characterized in that for continuous operation, said cover is spaced from said discharge orifice and is continuously rotated by a motor.

9. Apparatus according to claim 8, characterized in that said cover is on a connector mounted on the outside of the container bottom said discharge orifice comprises a ring on the container bottom.

10. Apparatus according to claim 1, characterized in that for continuous operation with dry materials, a suction pipe, a feed line and a cover are provided at the upper portion of said container.

11. Apparatus according to claim 1, including a fan between the toothed disc and the bearing for the shaft which carries the toothed disc the impeller of which is mounted on the shaft.

12. Apparatus according to claim 1, characterized in that the toothed disc has a thickness of 2 to 12 mm and a diameter of 100 to 90 mm.

13. Apparatus according to claim 12, characterized in that the particular impact face of the teeth is disposed radially from the toothed disc.

14. Apparatus according to claim 1, characterized in that the toothed disc has a bottom carrier disc with radially disposed cut-outs, teeth which are adapted to be inserted thereinto and mounted on the carrier disc, and a cover disc to fit on top.

15. Apparatus according to claim 14, characterized in that the teeth consist of rectangular flat plates which are armored on their leading edges.

16. Apparatus according to claim 15, characterized in that the upper rim of the container consists of non-magnetic material over the whole periphery and in that adjacent the lower zone of said container rim there is a fixed elongated magnet.

* * * * *